US005944174A

United States Patent [19]

Marco

[11] Patent Number: 5,944,174

[45] Date of Patent: Aug. 31, 1999

[54] TOP GRIP CONTAINER CLIP

[75] Inventor: Leslie S. Marco, Bloomingdale, Ill.

[73] Assignee: Illinois Tool Works, Inc., Glenview, Ill.

[21] Appl. No.: 09/006,859

[22] Filed: Jan. 14, 1998

[51] Int. Cl.[6] ..... B65D 75/00

[52] U.S. Cl. ..... 206/148; 206/151; 206/430

[58] Field of Search ..... 206/141, 142, 206/143, 145, 147, 148, 151, 152, 153, 155, 156, 158, 168, 199, 427, 430, 431; 294/87.2

[56] References Cited

U.S. PATENT DOCUMENTS

| | | | |
|---|---|---|---|
| 2,427,838 | 9/1947 | Cox | 224/45 |
| 2,514,858 | 7/1950 | Gray | 294/87.2 |
| 3,278,075 | 10/1966 | Weiss . | |
| 3,640,448 | 2/1972 | Wood | 229/40 |
| 4,465,180 | 8/1984 | Klygis . | |
| 4,545,485 | 10/1985 | Oliff | 206/434 |
| 5,593,026 | 1/1997 | Broskow . | |
| 5,642,808 | 7/1997 | Marco et al. . | |

*Primary Examiner*—Paul T. Sewell
*Assistant Examiner*—Nhan T. Lam
*Attorney, Agent, or Firm*—Pauley Petersen Kinne & Fejer

[57] ABSTRACT

A multi-packaging device for carrying a plurality of containers. A panel is configured with an array of three-pointed apertures that are each engageable with a container neck portion. Each of the three-pointed apertures is formed by two longitudinal elongated openings and one lateral elongated opening in the panel, with extremities of the longitudinal elongated openings positioned along a longitudinal fold line of the panel. Side flaps are positioned adjacent to the fold line on either longitudinal side of the panel.

6 Claims, 1 Drawing Sheet

TOP GRIP CONTAINER CLIP

BACKGROUND OF THE INVENTION

1. Field of the Invention

This invention relates to a multi-packaging device for unitizing and carrying a plurality of containers.

2. Description of the Prior Art

Multi-packaging devices for unitizing and carrying a plurality of containers, more specifically bottles, are traditionally constructed from paperboard or a polymer material, such as polyethylene. An important design consideration in any multi-packaging device is the ability of the device to maintain the containers in a tight package that prevents excessive movement of the containers relative to each other.

Bottles and bottle-like containers are typically defined as including a cylindrical body portion, a tapered shoulder portion and a reduced diameter neck portion, often supporting a cap or some other closure. The term "containers" as used in this specification typically means bottles or bottle-like containers, however other containers may also be used that fall at least partially within the above definition. Such containers are often made of glass or plastic and generally transported in bulk quantities. Thus, a multi-packaging device that provides a maximum amount of support for a plurality of bottles is desired.

Klygis, U.S. Pat. No. 4,465,180, teaches a multi-packaging device having a plurality of bottle-engaging slits each bottle-engaging slit having a central junction region. The Klygis patent further teaches an intermediate slit positioned between each of the bottle-engaging slits. These intermediate slits are shown to extend longitudinally with respect to the device with extremities that extend toward a central portion of the device.

An additional desirable feature in such multi-packaging devices is a container removal mechanism. The tight unitization of the plurality of containers precludes easy removal of a single container without a mechanism to aid in removal. Broskow, U.S. Pat. No. 5,593,026, and Marco et al., U.S. Pat. No. 5,642,808, each teach container removal mechanisms, such as the "zip strips" taught by the Marco et al. patent, integrated with multi-packaging devices.

SUMMARY OF THE INVENTION

It is one object of this invention to provide a device that unitizes a plurality of containers into a tight package that resists movement of the containers relative to each other.

It is another object of this invention to provide a device that unitizes a plurality of containers in such a way to prevent splaying of the containers from a generally vertical position.

It is still another object of this invention to provide a device requiring a minimum amount of material that still maintains a unitized plurality of containers.

It is yet another object of this invention to provide a device that permits easy removal of individual containers from a unitized package of containers.

The present invention discloses a multi-packaging device for carrying a plurality of containers, such as bottles having a neck portion. The multi-packaging device is preferably constructed from a sheet of polymeric material and formed into a panel.

The panel preferably contains an array of three-pointed apertures each engageable with the neck portion of a container. Preferably, the array of three-pointed apertures is arranged in a plurality of lateral rows and longitudinal ranks, such as two rows and three ranks forming six three-pointed apertures for holding a total of six containers.

Each three-pointed aperture preferably comprises two longitudinal elongated openings extending generally along a longitudinal direction of the panel and one lateral elongated opening extending generally along a lateral direction of the panel. Each three-pointed aperture forms three arcuate tabs in the panel area surrounding each three-pointed aperture. The arcuate tabs engage the neck portion of the container when inserted into the three-pointed aperture, thus restricting movement of the container in a downward direction relative to the panel.

Side flaps are preferably positioned on opposite longitudinal sides of the panel. The side flaps are separated from the panel by a fold line which also extends along the longitudinal direction of panel. Preferably both longitudinal elongated openings of each of the three-pointed apertures have extremities that are positioned along the fold line of the panel.

In an assembled multi-packaging device, the containers are positioned tightly within the multi-packaging device and tend to resist easy removal of each container. Therefore, the side flaps are preferably at least partially separable from the panel, preferably along a line of weakness. Upon separation of the side flap, one or more three-pointed apertures are at least partially separated from the panel or the side flap. One or more containers are then easily removable from the multi-packaging device.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Figure 1:
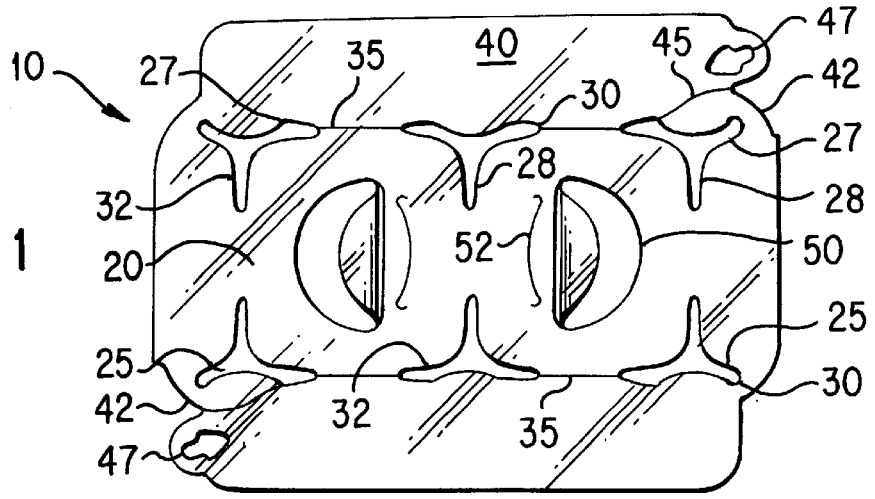
FIG. 1 is a top view of the multi-packaging device according to one preferred embodiment of this invention.
Figure 2:
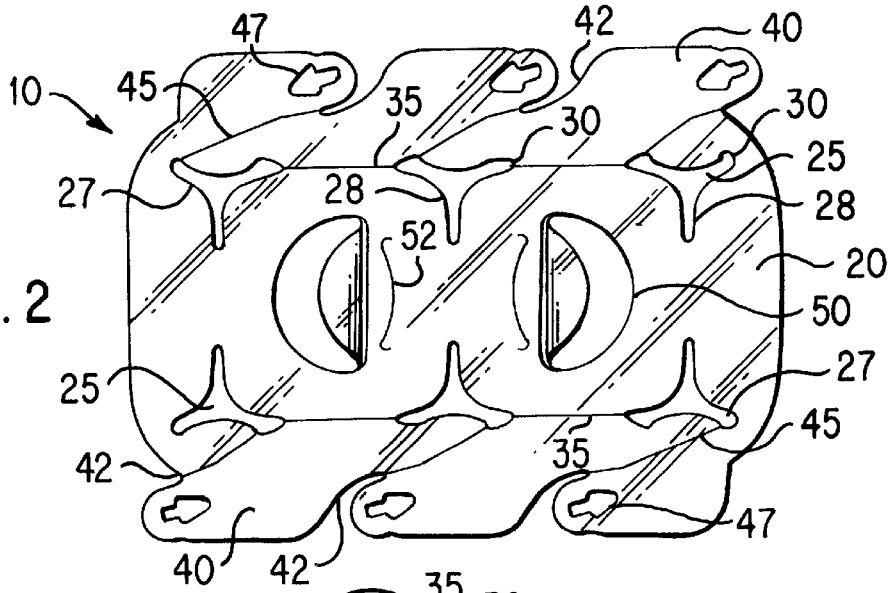
FIG. 2 is a top view of the multi-packaging device according to another preferred embodiment of this invention.
Figure 3:
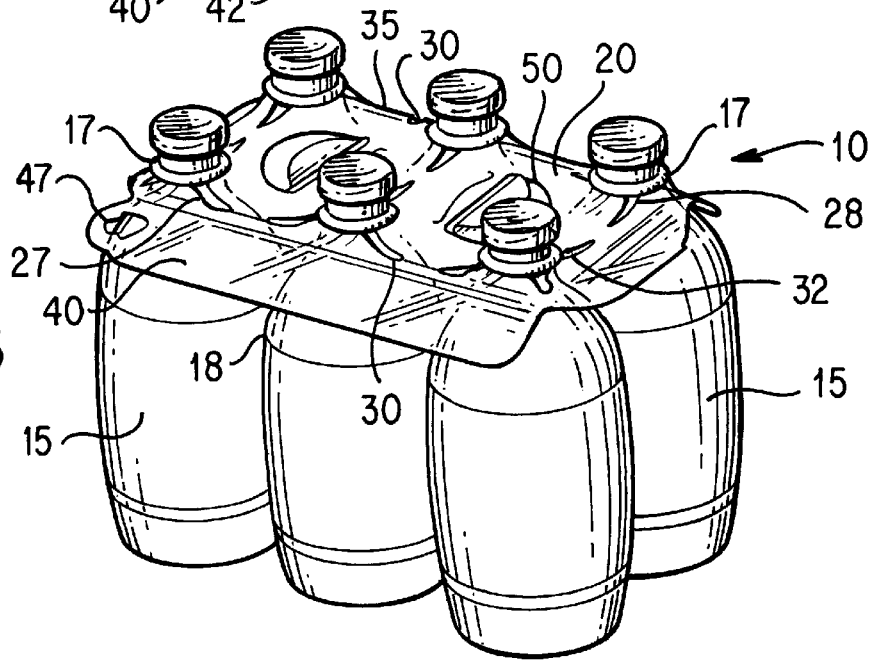
FIG. 3 is a perspective view of the multi-packaging device assembled with containers according to the preferred embodiment of this invention shown in FIG. 1.

FIGS. 1 and 2 each show, in unassembled form, a preferred embodiment of multi-packaging device 10. FIG. 3 shows an assembled version of multi-packaging device 10 carrying a plurality of containers 15. As shown in FIG. 3, containers 15 according to one preferred embodiment of this invention are bottles, or other container 15 known in the art having neck portion 17. Typically, neck portion 17 of container 15 forms a chime, a circular rib or other protuberance around the perimeter of an upper portion of container 15.

Multi-packaging device 10 is preferably constructed from a polymeric material such as high-density polyethylene. Other materials known to those having skill in the art, such as paperboard, may also be employed. The preferred material must have the proper stiffness to maintain containers 15 within a unitized array but at the same time have enough resilience to permit insertion of containers 15 into three-pointed apertures 25.

In one preferred embodiment of this invention, multi-packaging device 10 comprises a generally planar and generally rectangular sheet. The sheet is preferably extruded or otherwise manufactured and subsequently formed into panel 20. Panel 20 is preferably formed using a punch press to die cut and extract material and create the features of multi-packaging device 10 described below.

Panel 20 preferably contains an array of three-pointed apertures 25 each engageable with neck portion 17 of container 15. In one preferred embodiment of this invention the array of three-pointed apertures 25 is arranged in a plurality of lateral rows and a plurality of longitudinal ranks. As shown in FIGS. 1–3, a preferable array is an arrangement of two rows and three ranks to form multi-packaging device 10 for holding six containers 15. It should be noted, however, that although FIGS. 1–3 show multi-packaging device 10 for holding six containers 15, the invention is not intended to be so limited and multi-packaging device 10 may contain any feasible array of three-pointed apertures 25.

In one preferred embodiment of this invention, each three-pointed aperture 25 comprises two longitudinal elongated openings 27 extending generally along a longitudinal direction of panel 20 and one lateral elongated opening 28 extending generally along a lateral direction of panel 20. Each three-pointed aperture 25 forms three generally arcuate tabs 32 in a portion of panel 20 surrounding each three-pointed aperture 25. Arcuate tabs 32 engage neck portion 17 of container 15 when neck portion 17 is inserted into three-pointed aperture 25. The engagement between arcuate tabs 32 and neck portion 17 of container 15 restricts movement of container 15 in a downward direction relative to panel 20. Arcuate tabs 32, and preferably panel 20, are constructed from a material having sufficient stiffness to resist downward movement of engaged container 15 but have sufficient flexibility to allow neck portion 17 of container 15 to pass through three-pointed aperture 25 in an upward direction.

At least one, and preferably two, side flaps 40 are positioned on opposite sides of panel 20. In one preferred embodiment of this invention, side flaps 40 are positioned along the longitudinal direction of panel 20. Side flap 40 is separated from panel 20 by fold line 35 which preferably extends along the longitudinal direction of panel 20.

In an assembled multi-packaging device 10, as shown in FIG. 3, side flaps 40 preferably are positioned at an angle with respect to panel 20. In a preferred embodiment of this invention, side flaps 40 are generally parallel to tapered sidewall 18 of container 15. Side flaps 40 preferably help position containers 15 in a generally vertical position, generally parallel with respect to each other. In this regard, side flaps 40 help prevent outward splay of the lower portion of containers 15 within multi-packaging device 10. Side flaps 40 also preferably provide surface area for product logos and product information.

In a preferred embodiment of this invention, shown in FIGS. 1–3, side flaps 40 have a longitudinal length less than the overall longitudinal length of multi-packaging device 10. The shorter longitudinal length of side flaps 40 urges side flaps 40 into an angled position with respect to panel 20 and also represents a savings in material over full length side flaps 40.

In a preferred embodiment of this invention, at least one, and preferably both, longitudinal elongated openings 27 of each of the three-pointed apertures 25 have extremities 30 that are positioned along fold line 35 of panel 20. Extremities 30 along fold line 35 increase the tendency of side flaps 40 to fold along fold line 35 and also eliminate the need for intermediate slits between each three-pointed aperture 25. In another preferred embodiment of this invention, an entire longitudinal length of longitudinal elongated opening 27 is positioned generally along fold line 35. As a result of this configuration, fold line 35 creates a beam between side flap 40 and panel 20 that helps support an upward lifting force applied to panel 40 and maintains a tight configuration of containers 15 within multi-packaging device 10 by resisting splay of the lower portion of each container 15.

Panel 20 preferably forms handle 50 positioned between the lateral rows of three-pointed apertures 25. Handle 50 in one preferred embodiment of this invention comprises two opposing crescent-shaped cutouts as shown in FIGS. 1–3. Preferably, panel 20 also contains handle slit 52 adjacent each crescent-shaped cutout. Handle slit 52 may permit separation of material between handle 50 and panel 20 which both allows for a more resilient multi-packaging device 10 when fully loaded with containers 15 and spreads the load of containers 15 around panel 20 as well as contributing to a comfortable feel in handling the package.

In an assembled version of multi-packaging device 10, containers 15 are positioned tightly within multi-packaging device 10 thus resisting easy removal of each container 15. Therefore, in one preferred embodiment of this invention, one and preferably both side flaps 40 are at least partially separable from panel 20. Upon removal of side flap 40, three-pointed aperture 25 is preferably partially separated from panel 20 or side flap 40. As a result, container 15 is easily removable from three-pointed aperture 25 because at least one arcuate tab 32 is released from engagement with neck portion 17 of container 15.

In a preferred embodiment of this invention shown in FIG. 1, side flap 40 is completely separable along line of weakness 45 between an edge of side flap 40 and panel 20. Line of weakness 45 may comprise perforated line.

In another preferred embodiment of multi-packaging device 10, shown in FIG. 2, side flap 40 is partially separable along lines of weakness 45 between the edge of side flap 40 and each three-pointed aperture 25 to individually separate containers 15 from multi-packaging device 10.

In one preferred embodiment of this invention, the edge of side flap 40 contains notch 42 directed at an angle relative to panel 20. Notch 42 enables side flap 40 to be pulled along an angle with respect to panel 20 to sever line of weakness 45 and separate three-pointed aperture 25 from panel 20. In the preferred embodiment of this invention shown in FIG. 2, each additional, separately removable portion of side flap 40 contains an additional notch 42 for directing the angle of removal of side flap 40. In a preferred embodiment of the invention, notch 42 is marked with arrow 47 to indicate the direction of separation of line of weakness 45.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

I claim:

1. A multi-packaging device for carrying a plurality of containers each having a neck portion, the multi-packaging device comprising:

a panel having an array of three-pointed apertures each forming three generally arcuate tabs engageable with the neck portion of one of the containers, the array arranged in a plurality of lateral rows and a plurality of longitudinal ranks, each of the three-pointed apertures comprising two longitudinal elongated openings extending generally along a longitudinal direction of the panel and one lateral elongated opening extending generally along a lateral direction of the panel;

the longitudinal elongated openings of each of the three-pointed apertures having an entire longitudinal length positioned generally along a fold line of the panel, the fold line extending generally along the longitudinal direction; and at least one side flap of the panel positioned along the longitudinal direction and adjacent to the fold line.

2. The multi-packaging device of claim 1 wherein the panel forms a handle positioned between the lateral rows.

3. The multi-packaging device of claim 1 wherein the at least one side flap contains a notch directed at an angle relative to panel.

4. The multi-packaging device of claim 1 wherein the at least one side flap is at least partially separable from the panel.

5. The multi-packaging device of claim 4 wherein the at least one side flap is completely separable along a line of weakness between the side flap and the panel.

6. The multi-packaging device of claim 4 wherein the at least one side flap is partially separable along a line of weakness between the side flap and at least one three-pointed aperture and each additional portion of the at least one side flap is partially separable along at least one additional line of weakness between the side flap and at least one additional three-pointed aperture.

* * * * *